US006883205B2

(12) United States Patent
Martinez-Muñoz

(10) Patent No.: US 6,883,205 B2
(45) Date of Patent: Apr. 26, 2005

(54) HINGE COVER

(75) Inventor: Herbert Omar Martinez-Muñoz, Gainesville, GA (US)

(73) Assignee: Corporate Buying And Marketing Services, Inc., Lawrenceville, GA (US)

( * ) Notice: Subject to any disclaimer, the term of this patent is extended or adjusted under 35 U.S.C. 154(b) by 0 days.

(21) Appl. No.: 10/359,948

(22) Filed: Feb. 6, 2003

(65) Prior Publication Data

US 2004/0154129 A1 Aug. 12, 2004

(51) Int. Cl.[7] ..... E05D 11/00
(52) U.S. Cl. ..... 16/251; 16/250
(58) Field of Search ..... 16/250, 251

(56) References Cited

U.S. PATENT DOCUMENTS 3,961,602 A * 6/1976 Dresser ..... 118/505
4,691,409 A * 9/1987 Torgerson et al. ..... 16/250
5,056,191 A * 10/1991 Love ..... 16/251
5,198,031 A * 3/1993 Derstine ..... 118/505
5,224,240 A * 7/1993 Smith et al. ..... 16/251
5,722,120 A * 3/1998 Bindschatel et al. ..... 16/250
6,248,173 B1 * 6/2001 Dixon ..... 118/505
6,555,169 B2 * 4/2003 Lynch ..... 427/282

* cited by examiner

*Primary Examiner*—Suzanne L. Barrett
*Assistant Examiner*—Mark Williams
(74) *Attorney, Agent, or Firm*—Hinkle & O'Bradovich, LLC

(57) ABSTRACT

An apparatus and system for protecting hinges, including hinge plates, hinge loops and pins and related hardware from paint is disclosed. While painting doors, the apparatus and system can be used to protect the hinge hardware from paint without having to remove the hinge hardware from the door and door frame. In general, the apparatus and system includes a hinge plate cover that includes a magnetic material around the periphery of the cover. The apparatus and system further includes a hinge loop and pin cover that typically includes an elastic band that can optionally include a sealed end or a grip tab.

10 Claims, 4 Drawing Sheets

HINGE COVER

BACKGROUND OF THE INVENTION

I. Field of the Invention

The present invention relates generally to the field painting and protective painting devices, and more particularly to an apparatus and system for protecting hinges, including hinge plates and hinge barrels and pins, from paint.

II. Description of the Related Art

When painting frames, walls and doors, the hardware including the hinge hardware on doors typically must be removed from the door to prevent paint from coming in contact with the hardware. Removing the hardware can be time consuming and can potentially damage the hardware, door and frame. Often times, instead of removing the hardware, the painter places adhesive tape, such as masking tape over the hardware and then subsequently paint the doors frames and walls simply painting over the tape. While this method provides good protection from the paint, the tape must be carefully shaped to approximate the shape of the hardware. In addition, if the tape is incorrectly placed, it is often difficult to remove and replace the tape since the adhesive is tacky. Further, the adhesive can leave residue which must then be removed either physically or by using a solvent that can damage the finish on the hardware.

SUMMARY OF THE INVENTION

In general, the invention features a hinge cover that protects the hinge hardware while painting doors. The hinge cover generally protects hinge hardware including the hinge plates, hinge barrels and pins, screws and other related hardware. The hinge cover typically includes a hinge plate protector and a hinge barrel and pin protector. The hinge cover allows ease of placement and replacement as needed and can be easily placed and replaced.

In general, in one aspect, the invention features a hinge cover for hinge hardware on a door and door frame, the hardware including a hinge plate, hinge barrels and hinge pin, the hinge cover including a hinge plate cover having a first side and a second side, the hinge plate cover including a flexible body and a periphery magnet connected to one of the first and second surfaces along the periphery of the body, the hinge plate cover being adapted to magnetically adhere to the hinge plate and cover the hinge plate and a portion of the hinge barrel and a hinge barrel and pin cover adapted to be stretched over the hinge pin and barrels thereby covering the hinge pin and barrels.

In one implementation, the hinge plate cover is a flexible material that is non-absorbable to paint and other similar solvents.

In another implementation, the periphery magnet includes at least one space in the periphery to accommodate a portion of the hinge pin and barrels when the hinge cover is placed on the hinge plate.

In another implementation, the space is non-magnetic.

In another implementation, a space is formed between the surface of the body connected to the periphery magnet and the hinge plate, thereby suspending the body over the hinge plate.

In another implementation, the surface of the body opposite to the surface connected to the periphery magnet is exposed to subsequent painting.

In another implementation, the hinge barrel and pin cover is an elastic band.

In another implementation, the elastic band has one open side.

In another implementation, the elastic band has a closed side, and wherein the open side is adapted to be stretched over the hinge barrels and hinge pin.

In still another implementation, the hinge barrel and pin cover further comprises a tab connected to the closed side of the elastic band.

In another aspect, the invention features a hinge cover kit for protecting hinge hardware from paint and other solvents, the kit including a hinge plate cover adapted to cover a hinge plate and portion of the hinge barrel, the hinge plate cover including flexible body adapted to protect the hinge plate and hinge barrels from paint, the hinge plate cover having a flexible body having an upper and lower surface and a periphery magnet connected to the lower surface and an elastic hinge barrel and pin cover adapted to be fit over a hinge pin and barrels to protect the hinge pin and barrels from paint, the hinge barrel and pin cover having one open side.

In one implementation, the hinge plate further comprises non-magnetic gaps in the magnetic periphery, the gaps being adapted to receive a portion of the hinge barrels and hinge pin and to provide a flex point for the flexible body.

In another implementation, the upper surface is adapted to receive paint thereby protecting an underlying hinge plate.

In another implementation, the lower surface of the body and the periphery magnet are adapted to form a space in conjunction with a hinge plate.

In another implementation, the elastic hinge barrel and pin cover further comprises a closed side adapted to prevent paint from coming in contact with the hinge barrels and pin.

In another implementation, the kit optionally includes a tab connected to the closed side of the elastic hinge barrel and pin cover.

In still another aspect, the invention features a hinge cover, including a flexible body approximating the shape of a portion of hinge hardware for a door and door frame, thereby providing a barrier between a paint source and the portion of the hinge hardware covered by the flexible body, means for connecting the flexible body to the hinge hardware, the means located between the flexible body and the hinge hardware, wherein as pace is formed between the flexible body and the hinge hardware, an elastic body having an overall length less than the overall length of a hinge pin and hinge barrel of a hinge hardware set, the elastic body being adapted to be stretched over a portion of the hinge hardware including the hinge pin and hinge barrel and means for forming a barrier between a paint source and the portion of the hinge hardware covered by the elastic body.

In one implementation, the means for connecting the flexible body to the hinge hardware is a periphery magnet.

One advantage of the invention is that hinge hardware is protected during the painting of doors on which the hardware is installed and the adjacent frames and walls.

Another advantage of the invention is that the hinge hardware does not need to be removed from a door when the door and adjacent frames and walls are painted.

Another advantage is that the doors and the hinge hardware are not potentially damaged from removal.

Another advantage is that the invention does not leave any residue or other material on the hinges when the hinge cover is removed.

Another advantage of the invention is that the hinge cover can be discarded after use.

Another advantage of the invention is that the hinge cover can be reused after use.

Another advantage of the invention is that the hinge cover can be easily adjusted while already placed on the hinge hardware.

Another advantage of the invention is that with the hinge cover applied, the door hardware can function as normal and the door can be freely opened and closed without interference from the hinge cover.

Other objects, advantages and capabilities of the invention will become apparent from the following description taken in conjunction with the accompanying drawings showing the preferred embodiment of the invention.

DETAILED DESCRIPTION OF THE INVENTION

Figure 1:
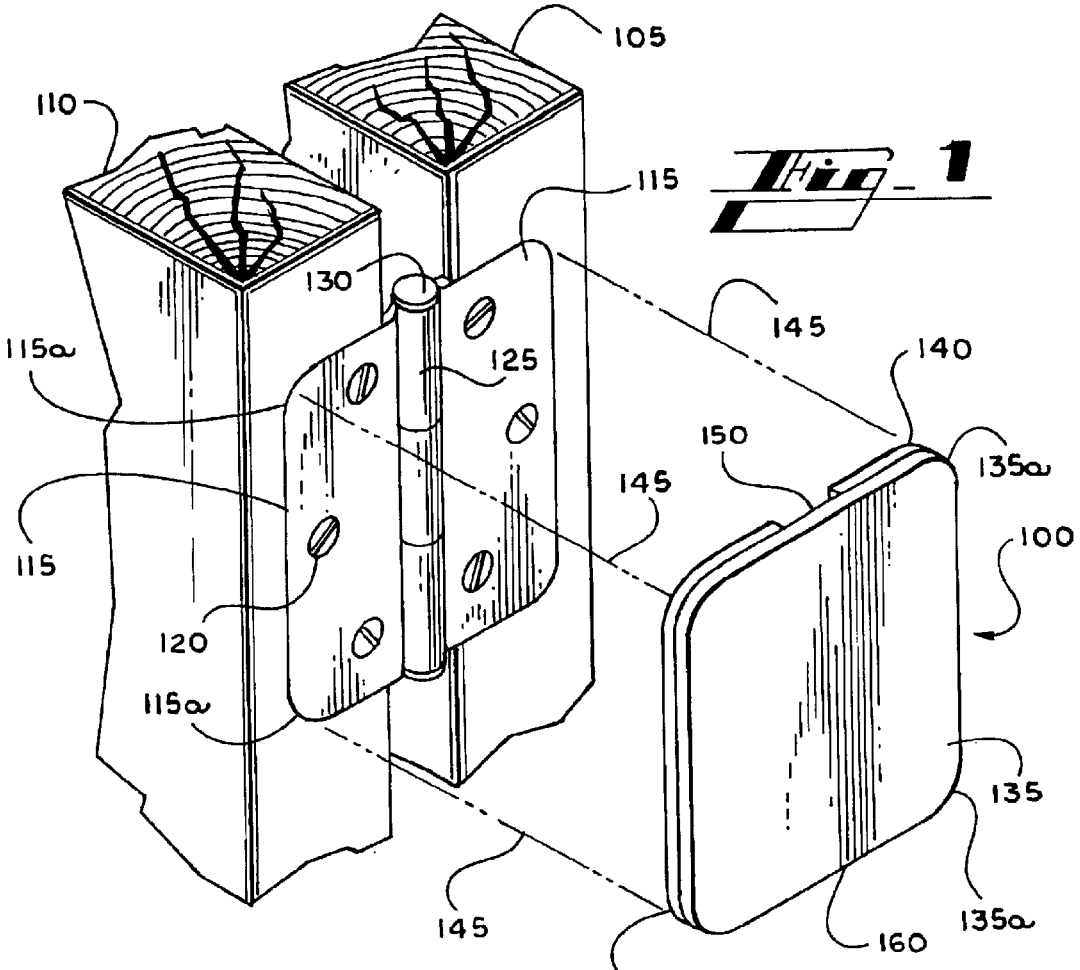
FIG. 1 illustrates a hinge plate of a typical door and an embodiment of a hinge plate cover.
Figure 2:
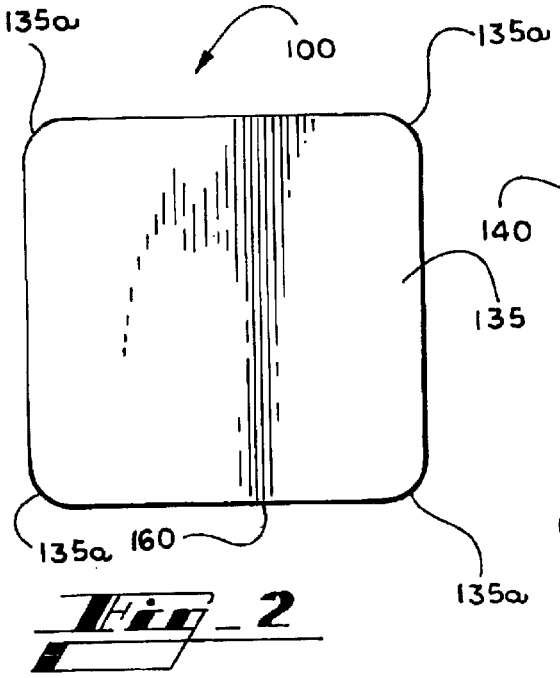
FIG. 2 illustrates a top view of an embodiment of a hinge plate cover.

Referring to the drawings wherein like reference numerals designate corresponding parts throughout the several figures, reference is made first to FIG. 1 that illustrates a hinge plate of a typical door and an embodiment of a hinge plate cover 100 in proximity to a typical door 105 and adjacent frame 110. Reference is also made to FIG. 2 that illustrates a top view of an embodiment of a hinge plate cover 100 and FIG. 3 that illustrates a bottom view of an embodiment of a hinge plate cover 100.

The door 105 and frame 110 typically include hinge hardware including a hinge plate 115, typically having a portion connected to the door 105 and a portion connected to the frame 110. Typical hinge hardware is metal and therefore has magnetic properties allowing magnets to be attached to it through magnetic forces. Hinge hardware is typically standardized for builders and therefore is manufactured in predictable shapes and dimensions. Each portion of a typical hinge plate 115 has four flat edges and two rounded corners 115*a*. It is understood that other shapes and dimensions for hinge hardware is also contemplated in other embodiments.

The hinge plate 115 is typically connected to its respective door 105 or frame 110 by attachment hardware such as screws 120. The hinge hardware typically also includes hinge plate barrels 125 along one edge of the hinge plate 115 portions, typically opposite the edge having the rounded corners 115*a*. The barrels 125 are located on the respective hinge plate 115 portions in an alternating manner so that the barrels 125 of the respective hinge plate 115 portions can connect in an interleaved manner, thereby effectively forming a hinge pin cylinder through which a hinge pin 130 can be inserted. A hinge pin 130 is then typically inserted through the interleaved barrels 125, or hinge pin cylinder, to hold the hinge plate 115 portions together, thereby also providing a pivot point for the door 105 and frame 110 system.

It is understood that the door 105 and frame 110 shown in FIG. 1 is in an open position, thereby exposing the hinge plate 115. The hinge plate 115 portions are shown with approximately 180 degrees between them. It is also understood that the door 105 can be open so that a variety of angles, typically 0–180 degrees or more, can be formed between the hinge plate 115 portions.

Figure 3:
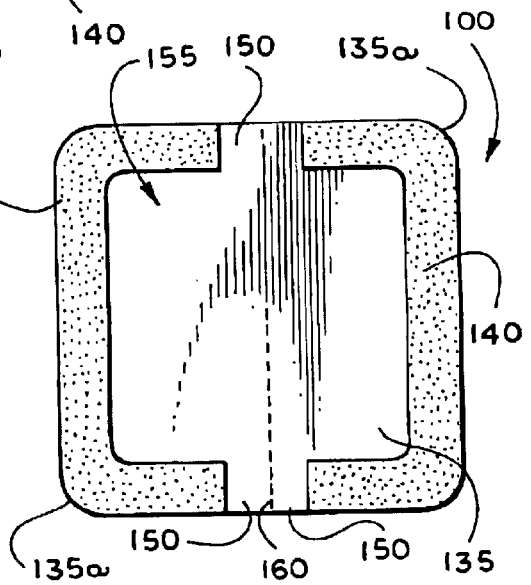
FIG. 3 illustrates a bottom view of an embodiment of a hinge plate cover.

The hinge plate cover 100 typically includes a main body 135 and a magnetic periphery 140, which are both described in further detail with respect to FIGS. 2–3. The main body 135 typically has a shape approximating the shape of the hinge plate 115 taking into account the space between the hinge plate 115 portions due to the barrels 125 and pin 130. As described above the hinge plates 115 have typical dimensions and shapes. In one embodiment, the body 135 has four straight edges as well as four rounded corners 135*a*. The body 135 is therefore adapted to completely cover the exposed hinge plate 115 and corresponding exposed portions of the barrels 125 and pin 130 when the hinge cover 100 is placed over the hinge hardware as indicated by lines 145, thereby protecting the exposed hinge hardware from paint or other solvents and the like. The body is typically comprised of a flexible material that does not absorb paint, but also does not allow applied paint to drip or otherwise roll off the body 135. The flexibility of the material used for the body allows for free movement of the door 105 with respect to the frame 110 while the door 105 and frame 110 are being painted by the user. In general, the hinge cover 100 does not flex much during use unless the door 105 and therefore the hinge plate 115 moves through a large angle. The hinge cover 100 typically flexes at the approximate center line 160 of the hinge cover 100. A space 150 in the magnetic periphery 140 typically allows this flexibility about the center line 160. In an implementation, the body can be comprised of non-absorbable plastic or foam of varying types. In another implementation, the material can be more or less flexible, that is, either rigid or flaccid.

In order for the hinge cover to remain affixed to the hinge plate 115, the magnetic periphery 140 affixes to the hinge plate 115 portions around the periphery of the hinge plate 115. As described above, the hinge hardware is typically metal thereby allowing a magnet to remain adhered to the hinge plate 115 during painting. The magnetic periphery 140 is large enough to provide enough magnetic force to remain strongly adhered to the hinge plate 115. However, the magnetic periphery 140 is small enough so that it can be adjusted as needed if it is not initially placed correctly. If the magnetic periphery provided too much magnetic force either by being too large or by being too highly magnetized, it would be difficult for a user to adjust the hinge cover 100 as needed. In this embodiment a user can simply slide the hinge cover 100 around the hardware without having to remove the hinge cover. If there were too much magnetic force between the magnetic periphery 140 and the hinge plate 115, the user would not easily be able to slide the hinge cover 100.

Also as described above the hinge plates 115 have typical dimensions and shapes. In one embodiment, as described above, the body 135 has four straight edges and four rounded corners 135*a*. The magnetic periphery 140 approximates the shape of the body 135. The magnetic periphery 140 is connected along one surface of the body 135 along its periphery. The magnetic periphery 140 is not continuous. There is a space 150 at two parts of the magnetic periphery 140. The space 150 accommodates the portion of the barrels 125 that protrude from the surface of the hinge plate 115. The presence of the space creates two "C" shaped portions mirroring each other. This space creates a non-magnetic portion in the path of the periphery magnet 140. Therefore, the body 135 of the hinge cover 100 actually sits above the hinge plate 115 with a space 155 formed between the body 135 and 0 the hinge plate 115. The space 155 is created because the magnetic periphery 140 elevated the body 135 above the hinge plate 115. It is understood that the body 135 can be made into any shape that approximates the shape of the hinge plates 115 and the portion of the barrels 125 that protrude from the surface of the hinge plate 115.

The embodiment of the hinge plate cover 100 as described above is described with respect to a door 105 and frame 110 system. It is understood that the hinge plate cover 100 can also be used in conjunction with painting hinge plates 115 in other systems. For example, the hinge plate may be connected to a two door system such as French doors. It is understood that other embodiments of the hinge plate cover 100 are contemplated to accommodate these types of other hinge hardware.

The hinge plate cover 100 is one integral part of the complete hinge cover that completes the protection of the hinge hardware. The hinge plate cover 100 protects the hinge plate side of the door 105 and frame 100 system as described above, which includes an inside portion of the hinge barrels. The hinge pin side of the door 105 and frame 110 system is also protected by a hinge pin and barrel cover as is now described in detail.

Figure 4:
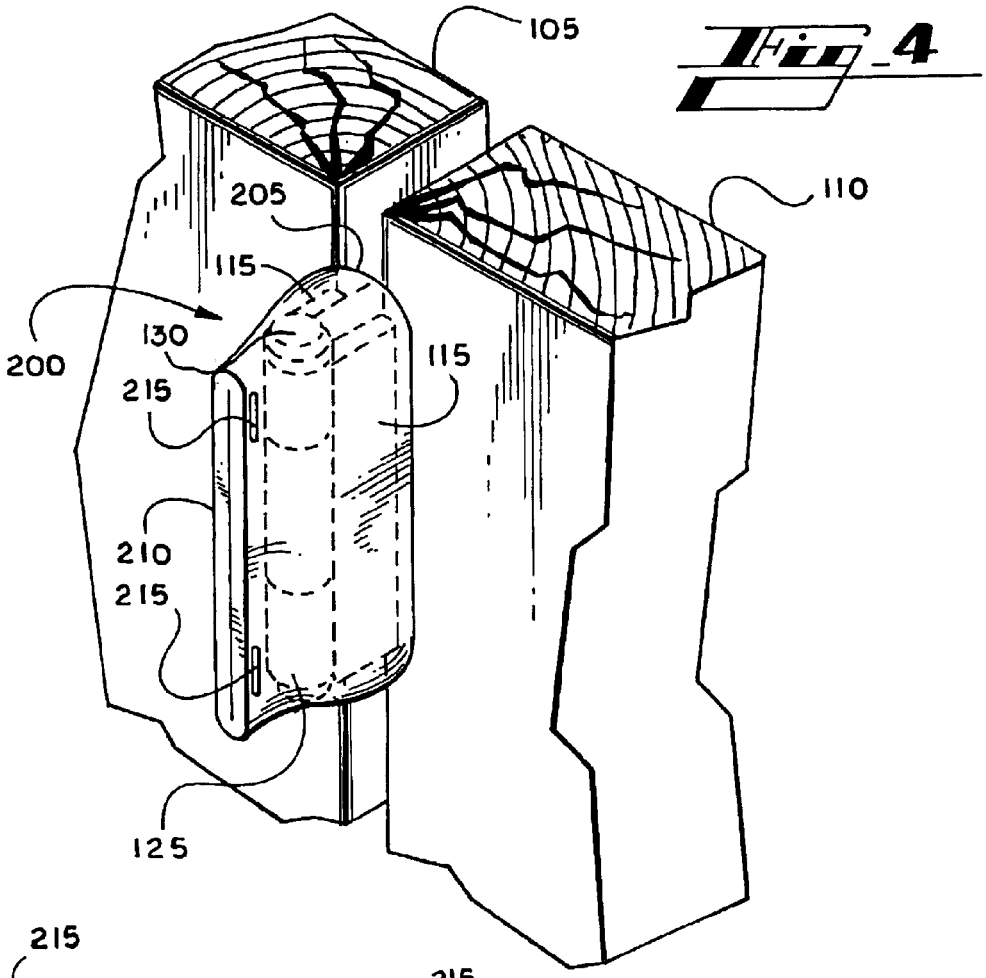
FIG. 4 illustrates a hinge barrel and pin of a typical door and an embodiment of a hinge barrel and pin cover.
Figure 5:
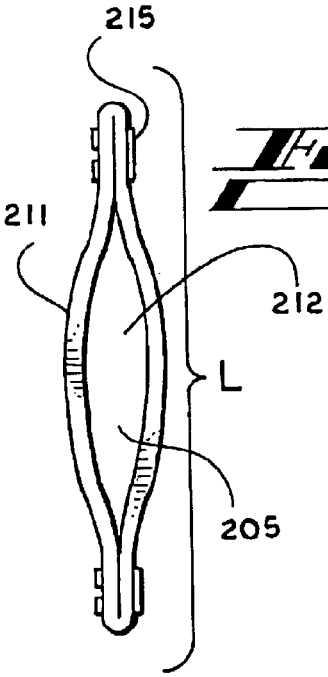
FIG. 5 illustrates a view of an embodiment of a hinge barrel and pin cover.
Figure 6:
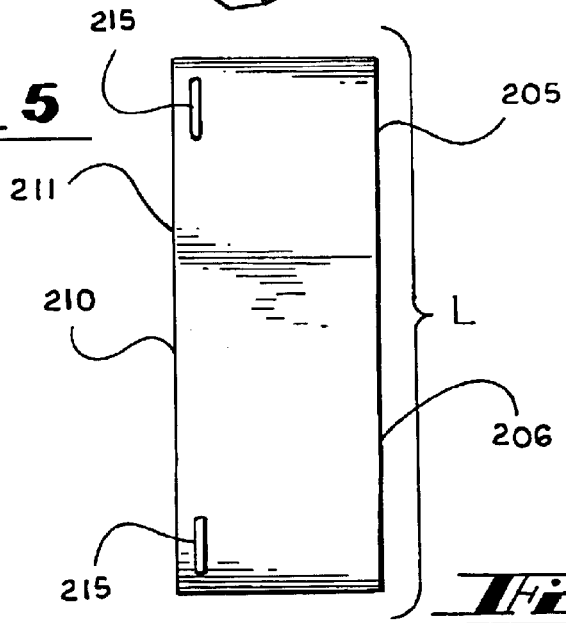
FIG. 6 illustrates a side view of an embodiment of a hinge barrel and pin cover.

FIG. 4 illustrates a hinge barrel 125 and pin 130 of a typical door and an embodiment of a hinge barrel and pin cover 200. FIGS. 5 and 6 are also described. FIG. 5 illustrates a view of an embodiment of a hinge barrel and pin cover 200 and FIG. 6 illustrates a side view of an embodiment of a hinge barrel and pin cover 200. As stated above, the hinge pin side of the door 105 and frame 110 system is shown. Similar to as described above, the door 105 can be opened and closed through a large range of angles. FIG. 4 illustrates the door 105 in a closed position in which the two portions of the hinge plate 115 (see above) would have about zero to a few degrees between them. The hinge hardware from this hinge side is shown in phantom including a part of the hinge plate 115, hinge barrels 125 and hinge pin 130. An embodiment of a hinge pin and barrel cover 200 is also shown. In a typical embodiment, the hinge pin and barrel cover 200 is elastic. In a typical implementation, the hinge pin and barrel cover 200 is a wide elastic band, similar to a large "rubber band", which is typically a continuous band, thereby having two open sides. The hinge pin and barrel cover 200 can include an open side 205 that fits over the hinge pin 130 and barrels 125, and a closed side 210 that the user can handle to cover the hinge hardware. If the hinge pin and barrel cover 200 does include a closed side 210, the closed side 210 can be closed in a variety of ways. In one implementation, staples 215 can be added to the cover 200 to partially close the side 210. In this way, when the cover 200 is put over the hardware, the side 210 is closed enough to keep paint out of the interior of the cover and therefore the hardware. In another implementation, the side 210 can be totally sealed, for example by heat, so that there is no opening at all. In another implementation, the side 210 can be sewn with stitching. In this way, the cover 200 appears to be in a form of an elastic "cup" having only one open side 205.

Regardless of the implementation of the cover 200, the over all length L of the cover can be less than the overall length of the hinge hardware, for example the hinge pin 130. The length L being less than the length of the hardware allows the cover 200 to be stretched over the hinge pin 130 and barrels 125 when it is used. By having to stretch the cover 200 over the hardware aids in creating a secure fit of the cover 200 on the hardware and allows a good seal from the paint. The material in the elastic band used for the cover, typically some rubber or other elastic material is non-absorbent to paint and other solvents but also does not allow the paint to readily drip or otherwise roll off during application.

Figure 7:
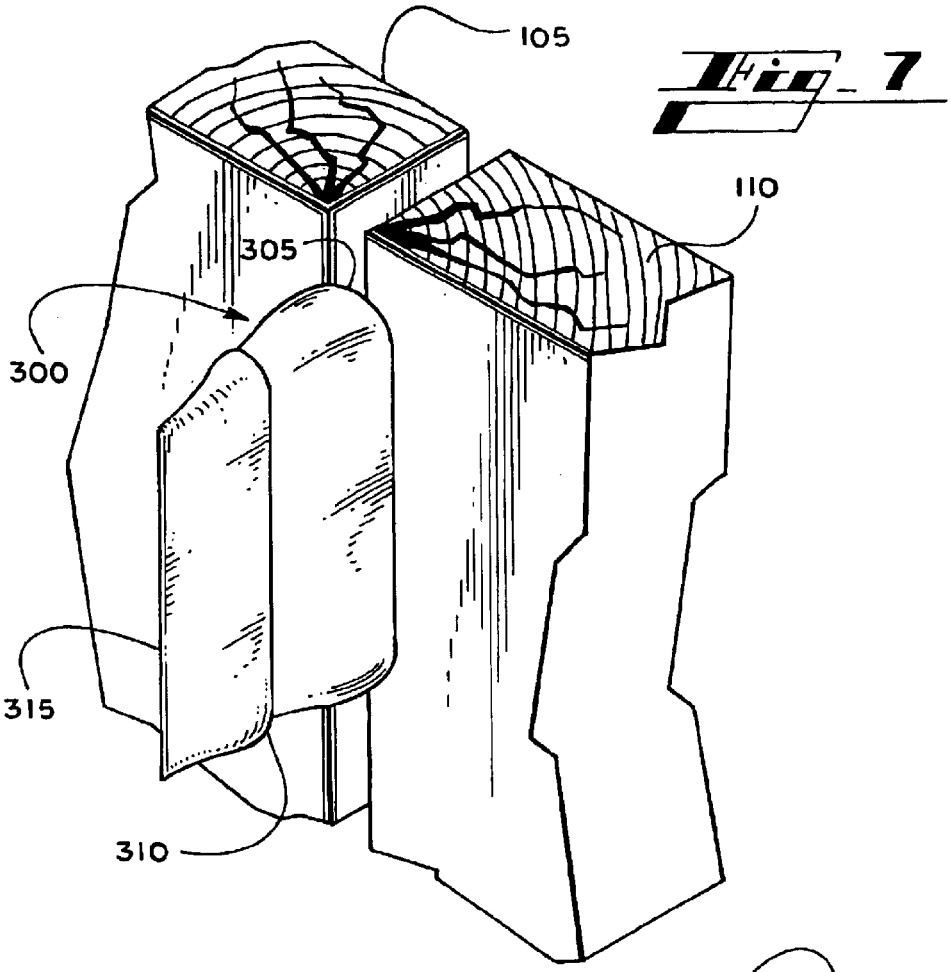
FIG. 7 illustrates a hinge barrel and pin of a typical door and an alternate embodiment of a hinge barrel and pin cover.
Figure 8:
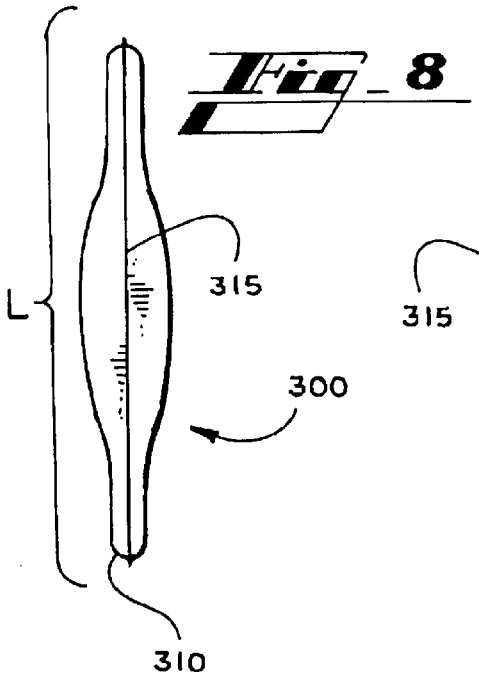
FIG. 8 illustrates a top view of an alternate embodiment of a hinge barrel and pin cover.
Figure 9:
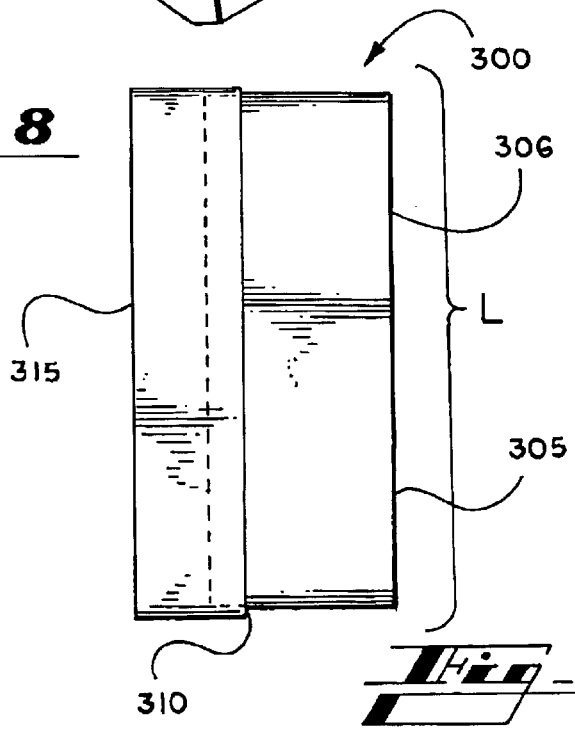
FIG. 9 illustrates a side view of an alternate embodiment of a hinge barrel and pin cover.

FIG. 7 illustrates a hinge barrel and pin of a typical door and an alternate embodiment of a hinge barrel and pin cover 300. FIGS. 8 and 9 are also described. FIG. 8 illustrates a top view of an alternate embodiment of a hinge barrel and pin cover 300 and FIG. 9 illustrates a side view of an alternate embodiment of a hinge barrel and pin cover 300. The hinge hardware from this hinge side is not shown but typically includes the same components as described above including a part of the hinge plate 115, hinge barrels 125 and hinge pin 130 (see FIGS. 1 and 4). An embodiment of a hinge pin and barrel cover 300 is also shown. In a typical embodiment, the hinge pin and barrel cover 300 is elastic. Similar to the previous embodiment (FIGS. 4–6), in a typical implementation, the hinge pin and barrel cover 300 is a wide elastic band, similar to a large "rubber band", which is typically a continuous band, thereby having two open sides. In this embodiment, the hinge pin and barrel cover 300 typically includes an open side 305 that fits over the hinge pin 130 and barrels 125, and a closed side 310 that the user can handle to cover the hinge hardware. The closed side 310 can be closed in a variety of ways such as described above with respect to the previous embodiment (FIGS. 4–6) such as with staples, heat seal or stitching. In this embodiment, a tab 315 is connected to the closed side 310. The tab 315 allows the user to obtain a firmer grip to the cover 300 for application and removal of the cover 300 to the hinge hardware. The tab 315 can typically be any suitable material that can attach to the elastic of the cover 300.

In the embodiments described above, the elastic covers 200, 300 are described as generally being a continuous elastic loop or elastic band, which is understood to have a large open space defined inside the loop. Therefore, the loop has two continuous perimeter edges 206, 211, 306, 311. Each edge 206, 211, 306, 311 therefore defines and opening or two open sides. The covers 200, 300 have also been described as an elastic cup having an open side 205, 305. The open side 205, 305 is defined by the continuous perimeter edge 206, 306. The closed side 210, 310 is defined by the continuous perimeter edge 211, 311, but which has generally been closed onto itself therefore closing one side of the continuous loop, therefore defining an interior 212 into which the hinge barrels 125 and hinge pin 130 are inserted. The closed side 210, 310 can be closed by the various devices described above. Typically, the closed side 210, 310 is heat sealed. Therefore, the now closed and sealed perimeter edge 211, 311 defines the tab that the user can grasp in order to attach the cover 200, 300 onto the hinge barrels 125 and hinge pin 130. In another typical embodiment, the cover 200 can be a specially manufactured integral piece. In another embodiment, as described above, an additional tab 315 can be connected to the closed side 210, 310.

Similar to the previous embodiment in FIGS. 4–6, the over all length L of the cover can be less than the overall length of the hinge hardware, for example the hinge pin 130. The length L being less than the length of the hardware allows the cover 300 to be stretched over the hinge pin 130 and barrels 125 when it is used. By having to stretch the cover 300 over the hardware aids in creating a secure fit of the cover 300 on the hardware and allows a good seal from the paint. The material in the elastic band used for the cover, typically some rubber or other elastic material is non-absorbent to paint and other solvents but also does not allow the paint to readily drip or otherwise roll off during application.

The following figures illustrate an embodiment of a hinge barrel and pin cover having a sealed side.

Figure 11:
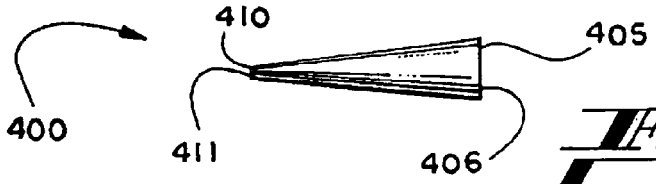
FIG. 11 illustrates a side view of another alternate embodiment of a hinge barrel and pin cover.
Figure 12:
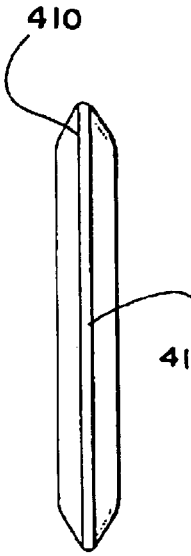
FIG. 12 illustrates a top view of another alternate embodiment of a hinge barrel and pin cover.
Figure 13:
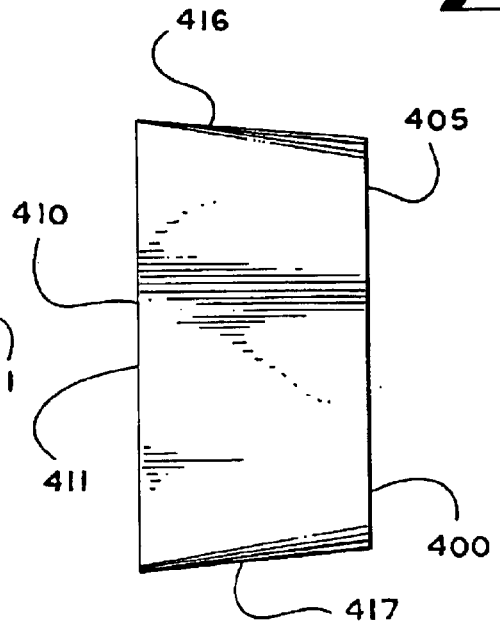
FIG. 13 illustrates another side view of another alternate embodiment of a hinge barrel and pin cover.
Figure 14:
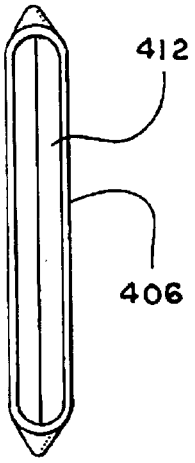
FIG. 14 illustrates a bottom view of another alternate embodiment of a hinge barrel and pin cover.
Figure 10:
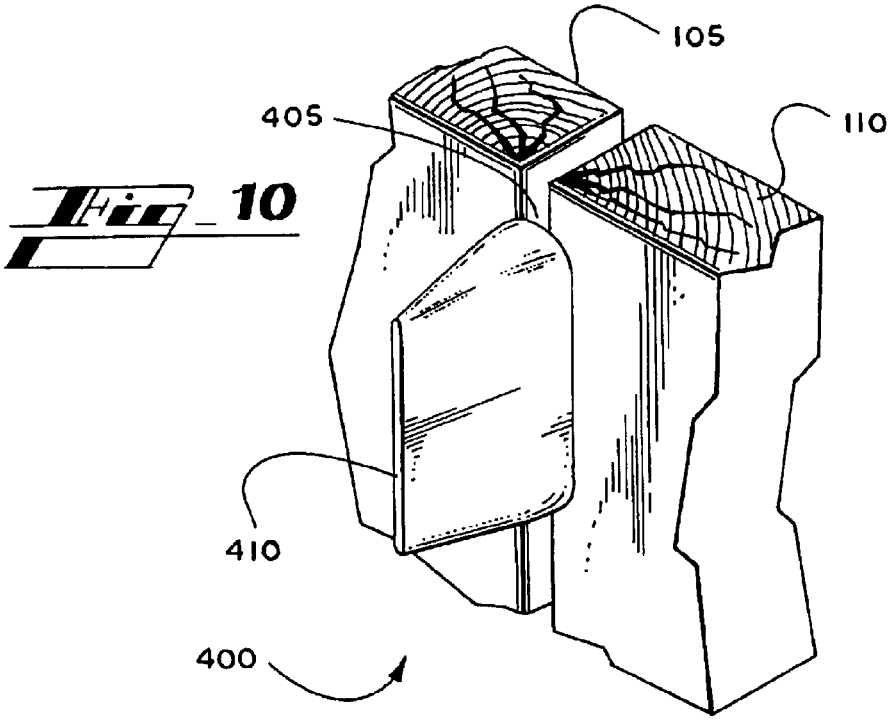
FIG. 10 illustrates a hinge barrel and pin of a typical door and another alternate embodiment of a hinge barrel and pin cover.

FIG. 10 illustrates a hinge barrel and pin of a typical door and another alternate embodiment of a hinge barrel and pin cover 400. FIGS. 11–14 are also described. FIG. 11 illustrates a side view of another alternate embodiment of a hinge barrel and pin cover 400. FIG. 12 illustrates a top view of another alternate embodiment of a hinge barrel and pin cover 400. FIG. 13 illustrates another side view of another alternate embodiment of a hinge barrel and pin cover 400. FIG. 14 illustrates a bottom view of another alternate embodiment of a hinge barrel and pin cover 400. The hinge hardware from this hinge side is not shown but typically includes the same components as described above including a part of the hinge plate 115, hinge barrels 125 and hinge pin 130 (see FIGS. 1 and 4). An embodiment of a hinge pin and barrel cover 400 is also shown. In a typical embodiment, the hinge pin and barrel cover 300 is elastic. Similar to the previous embodiment (FIGS. 4–6), in a typical implementation, the hinge pin and barrel cover 400 is a wide elastic cup defining an interior 412 into which the hinge pin and barrels are fit. The perimeter edge 406 defines an opening leading into the interior 412. Outer edges 416, 417 are tapered thereby allowing the perimeter edge 406 to define the opening for easy placement over the hinge pins and barrels. In this embodiment, the hinge pin and barrel cover 400 typically includes an open side 405 that fits over the hinge pin 130 and barrels 125, and a closed side 410 that the user can handle to cover the hinge hardware. The closed side 410 is a sealed side, typically heat sealed thereby defining the tab that the user can handle to place the hinge pin and barrel cover 400.

The embodiments of the hinge plate cover and hinge pin and barrel cover described above can generally be combined to be used as a hinge cover kit. By using the hinge plate cover and the hinge pin and barrel cover in conjunction, a user can obtain virtually complete paint protection while painting doors and adjacent frames and walls.

In general, the hinge covers described above by themselves or in conjunction with a kit provide a flexible body approximating the shape of a portion of hinge hardware for a door and door frame, thereby providing a barrier between a paint source and the portion of the hinge hardware covered by the flexible body, means to connect the flexible body to the hinge hardware, the means located between the flexible body and the hinge hardware, wherein a space is formed between the flexible body and the hinge hardware, an elastic body having an overall length less than the overall length of a hinge pin and hinge barrels of a hinge hardware set, the elastic body being adapted to be stretched over a portion of the hinge hardware including the hinge pin and means to form a barrier between a paint source and the portion of the hinge hardware covered by the elastic body.

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A hinge cover for hinge hardware on a door and door frame, the hardware including a hinge plate, a hinge barrel and hinge pin, the hinge cover comprising:

a hinge plate cover having a first side and a second side, the hinge plate cover including a flexible body and a periphery magnet connected to one of the first and second surfaces along the periphery of the body, the hinge plate cover being adapted to magnetically adhere to the hinge plate;

an elastic hinge barrel and pin cover defined generally by an elastic band having a first continuous perimeter edge defining an open end and a second continuous perimeter edge having been closed onto itself thereby defining a closed end adapted to be gripped by a user for placement over the hinge pin and hinge barrel, thereby covering the hinge pin and barrel; and wherein the hinge barrel and pin cover further comprises a tab connected to the closed end of the elastic band.

2. A hinge cover kit for protecting hinge hardware from paint and other solvents, the kit comprising:

a hinge plate cover adapted to cover a hinge plate, the hinge plate cover including flexible body adapted to protect the hinge plate from paint, the hinge plate cover having a flexible body having an upper and lower surface and a periphery magnet connected to the lower surface; and an elastic hinge barrel and pin cover adapted to be fit over a hinge pin and barrels to protect the hinge pin and barrels from paint, the hinge barrel and pin cover being generally defined by an elastic loop having a first continuous perimeter edge and a second continuous perimeter edge that has been closed onto itself thereby closing one side of the loop, the closed end defining a tab.

3. The kit as claimed in claim 2 wherein the hinge plate further comprises non-magnetic gaps in the magnetic periphery, the gaps being adapted to receive a portion of the hinge barrels and hinge pin and to provide a flex point for the flexible body.

4. The kit as claimed in claim 2 wherein the upper surface is adapted to receive paint thereby protecting an underlying hinge plate.

5. The kit as claimed in claim 2 wherein the lower surface of the body and the periphery magnet are adapted to form a space in conjunction with a hinge plate.

6. A hinge cover for hinge hardware on a door and door frame, the hardware including a hinge plate, a hinge barrel and hinge pin, the hinge cover comprising:

a hinge plate cover having a first side and a second side, the hinge plate cover including a flexible body and a periphery magnet connected to one of the first and second surfaces along the periphery of the body, the hinge plate cover being adapted to magnetically adhere to the hinge plate;

an elastic hinge barrel and pin cover defined generally by an elastic band having a first continuous perimeter edge defining an open end and a second continuous perimeter edge having been closed onto itself thereby defining a closed end adapted to be gripped by a user for placement over the hinge pin and hinge barrel, thereby covering the hinge pin and barrel;

wherein the periphery magnet includes at least one space in the periphery to accommodate a portion of the hinge pin and barrels when the hinge cover is placed on the hinge plate; and wherein the periphery magnet includes at least one additional space in the periphery to accommodate a portion of the hinge pin and barrels when the hinge cover is placed on the hinge plate, the two spaces thereby forming the periphery magnet into two mirror image C-shape portions.

7. The hinge cover as claimed in claim 6 wherein the hinge plate cover is a flexible material that is non-absorbable to paint and other similar solvents.

8. The hinge cover as claimed in claim 6 wherein the space is non-magnetic.

9. The hinge cover as claimed in claim 8 wherein a space is formed between the surface of the body connected to the periphery magnet and the hinge plate, thereby suspending the body over the hinge plate.

10. The hinge cover as claimed in claim 9 wherein the surface of the body opposite to the surface connected to the periphery magnet is exposed to subsequent painting.

* * * * *